US005722034A

United States Patent [19]

Kambara

[11] Patent Number: 5,722,034

[45] Date of Patent: Feb. 24, 1998

[54] METHOD OF MANUFACTURING HIGH PURITY REFRACTORY METAL OR ALLOY

[75] Inventor: Syozo Kambara, Tokyo, Japan

[73] Assignee: Japan Energy Corporation, Tokyo, Japan

[21] Appl. No.: 567,795

[22] Filed: Dec. 5, 1995

[30] Foreign Application Priority Data

Dec. 9, 1994 [JP] Japan ..... 6-330929

[51] Int. Cl.[6] ..... B22F 1/00

[52] U.S. Cl. ..... 419/26; 419/29; 419/38

[58] Field of Search ..... 419/26, 29, 38

[56] References Cited

U.S. PATENT DOCUMENTS 4,370,299 1/1983 Morozumi .

5,224,534 7/1993 Shimizu et al. .

*Primary Examiner*—Charles T. Jordan

*Assistant Examiner*—Anthony R. Chi

*Attorney, Agent, or Firm*—Panitch Schwarze Jacobs & Nadel, P.C.

[57] ABSTRACT

A method of manufacturing a high-purity refractory metal or a an alloy based thereon, said refractory metal being selected from the group consisting of niobium, rhenium, tantalum, molybdenum, and tungsten, comprising the steps of compacting a mixed material, in the form of powders or small lumps, of a refractory metal or alloy to be refined together with one or two or more additive elements selected from the group of transition metal elements consisting of vanadium, chromium, manganese, iron, cobalt and nickel, and from the group of rare earth elements, sintering the resulting compact at a high temperature of at least 1000° C. and a high pressure of at least 100 MPa, thereby forming a lower compound or nonstoichiometric compound between at least a part of the additive element or elements and the impurity gas ingredient element such as O, N, C, and H, contained in the refractory metal or alloy to be refined, and thereafter electron-beam melting the sintered body. The material's functions (superconductivity, corrosion resistance, high temperature resistance, etc.) and workability (forging, rolling, and cutting properties) are markedly improved.

17 Claims, 9 Drawing Sheets

Schematic view of a compact

[FIG. 1]
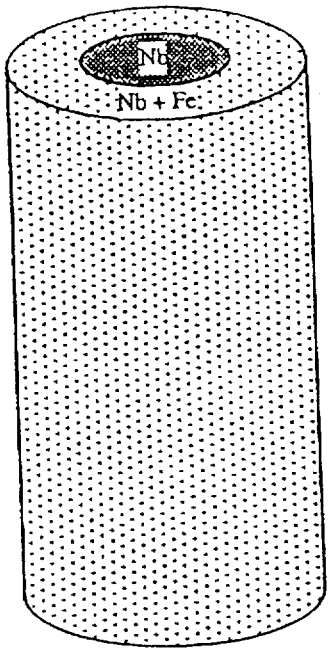
Schematic view of a compact
[FIG. 2]
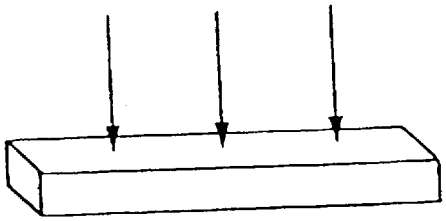
Vickers hardness
measuring points

[FIG. 3]
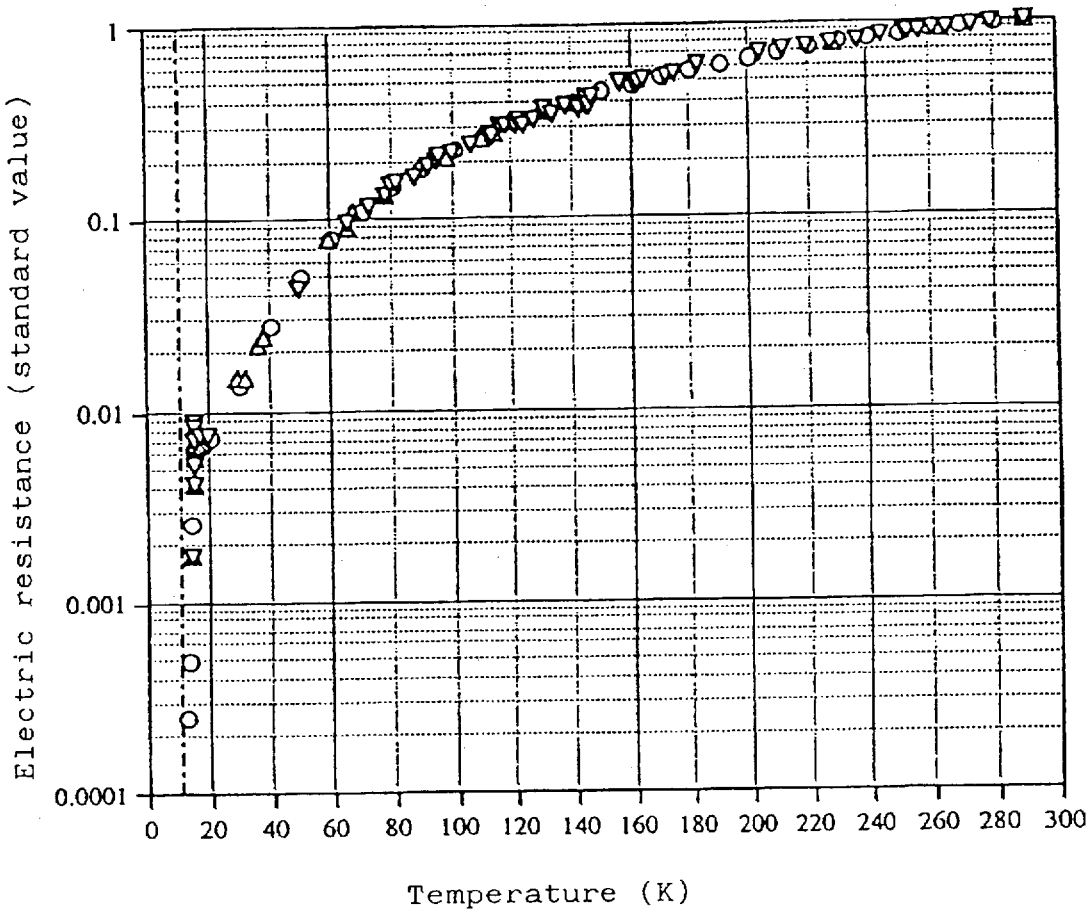
Temperature versus electric resistance of 40 mm-dia. high purity Nb ingots

[FIG. 4]
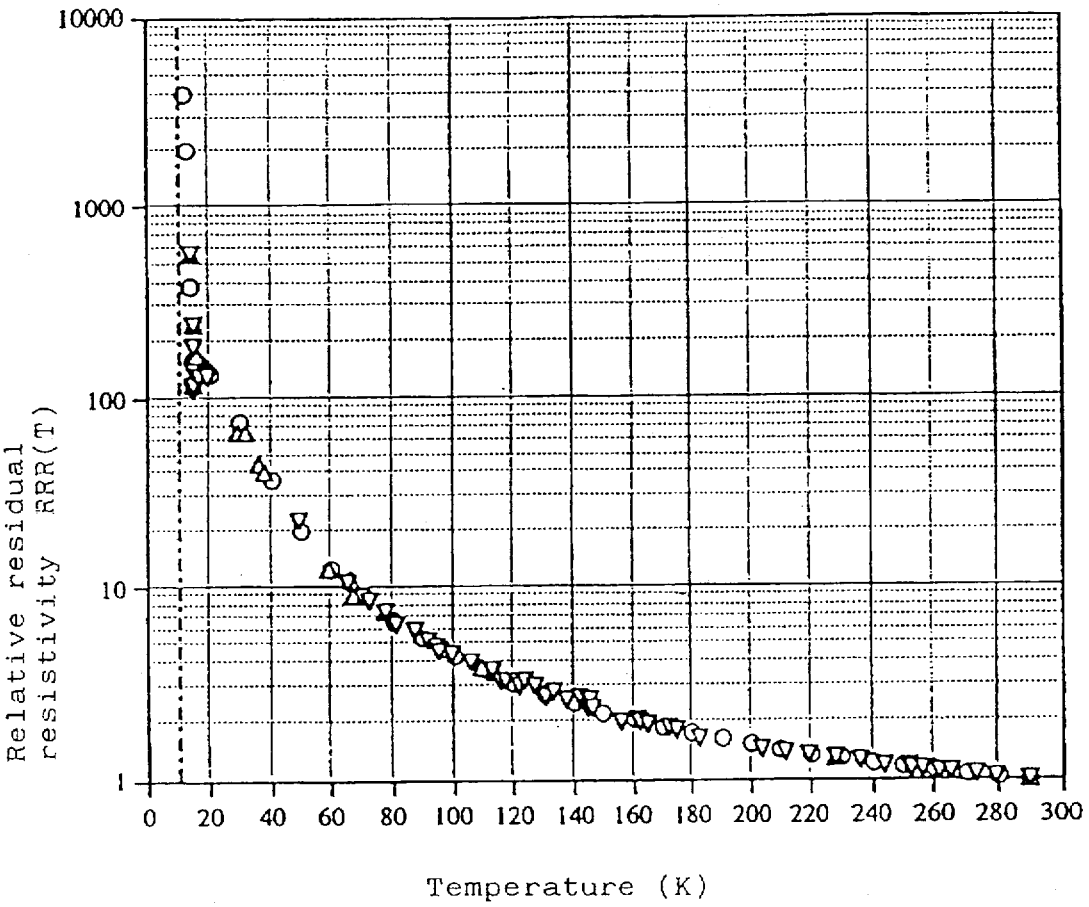
RRR values (as a function of temperature) of 40 mm-dia. high purity Nb ingots

[FIG. 5]
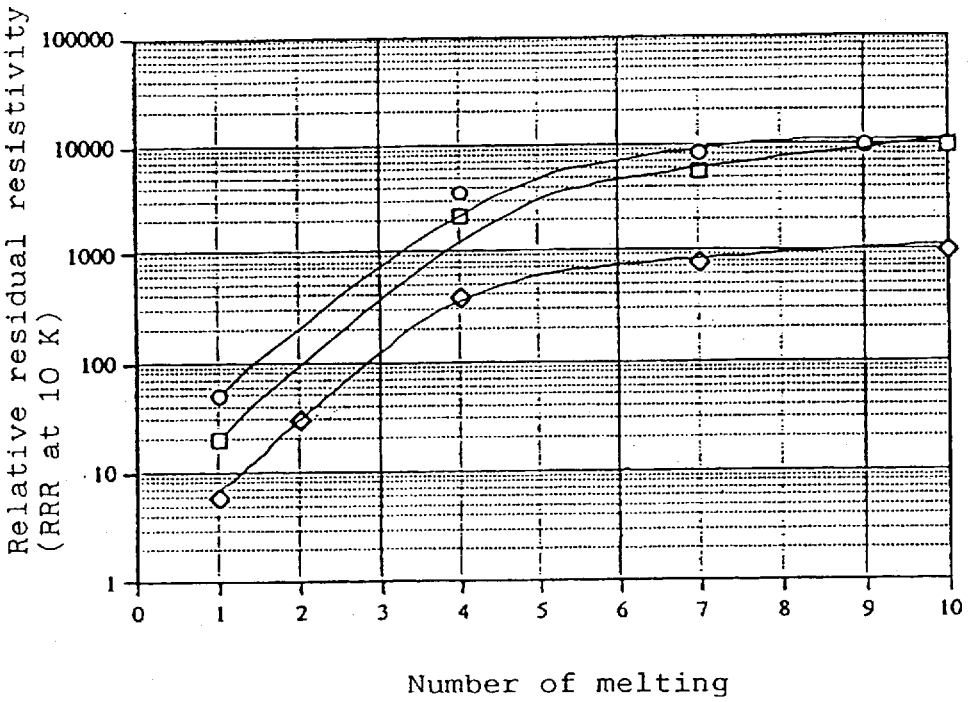
Relative residual resistivity (RRR) versus melting number of 40 mm-dia. Nb ingots

[FIG. 6]
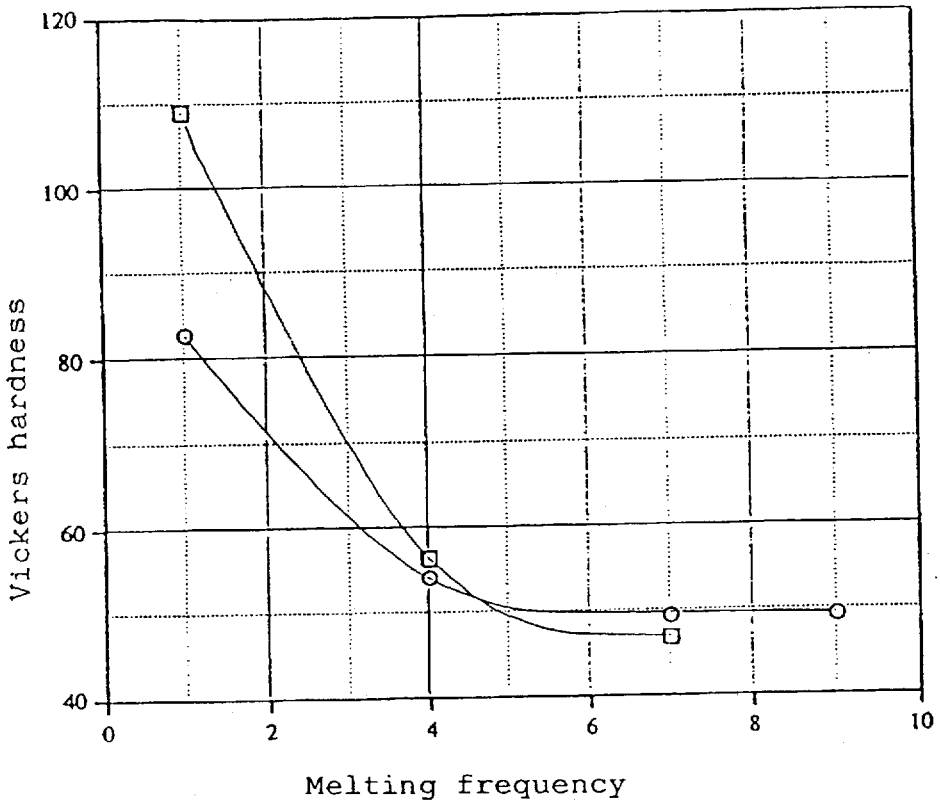
Vickers hardness versus number of melting of 40 mm-dia. Nb ingots

[FIG. 7]
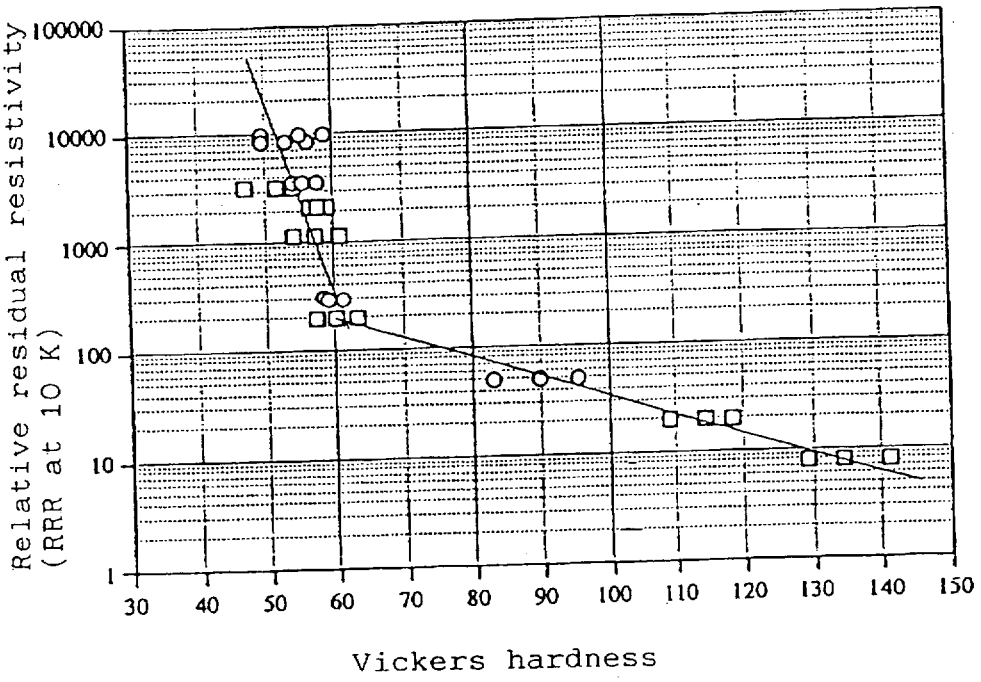
Relative residual resistivity (RRR) versus Vickers hardness of 40 mm-dia. superhigh purity Nb ingots

[FIG. 8]
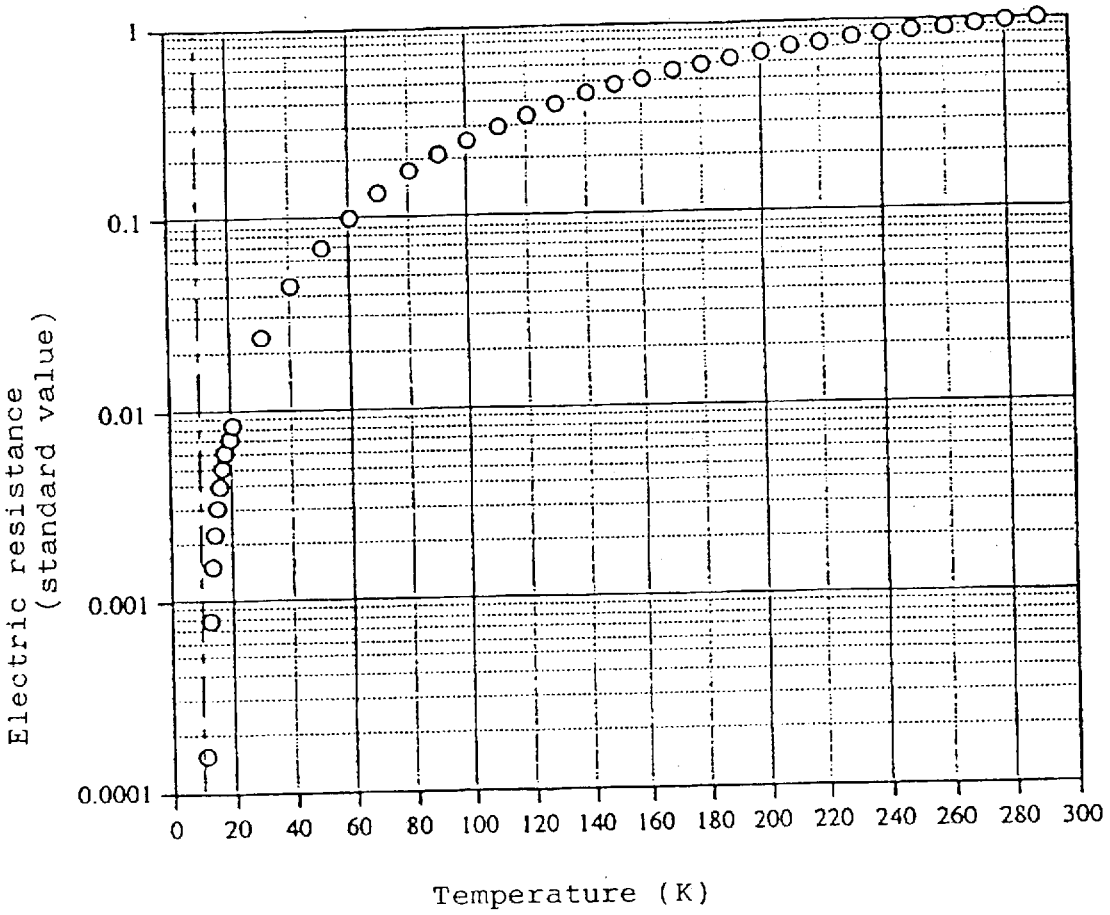
Electric resistance versus temperature of 100 mm-dia. Nb ingots (under 15 K, by optimum curve approximation)

[FIG. 9]
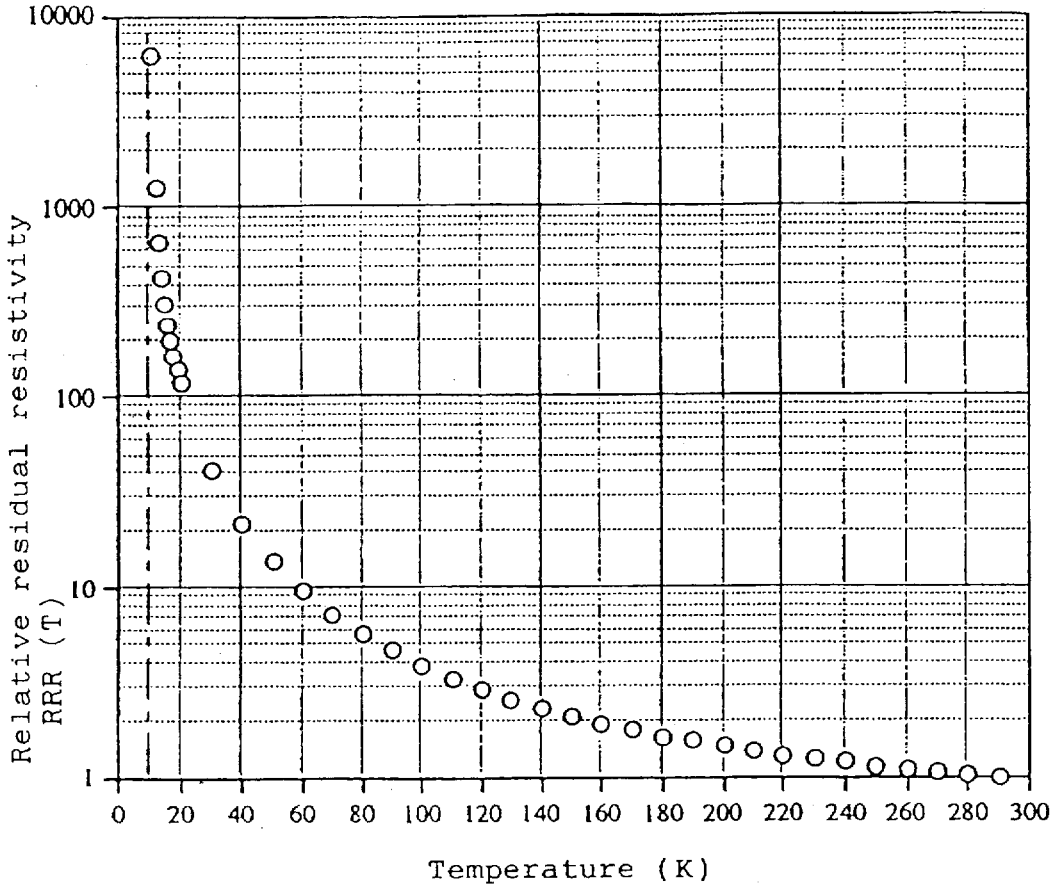
Relative residual resistivity (RRR) of 100 mm-dia. superhigh purity Nb ingot (under 15 K, by optimum curve approximation)

[FIG. 10]
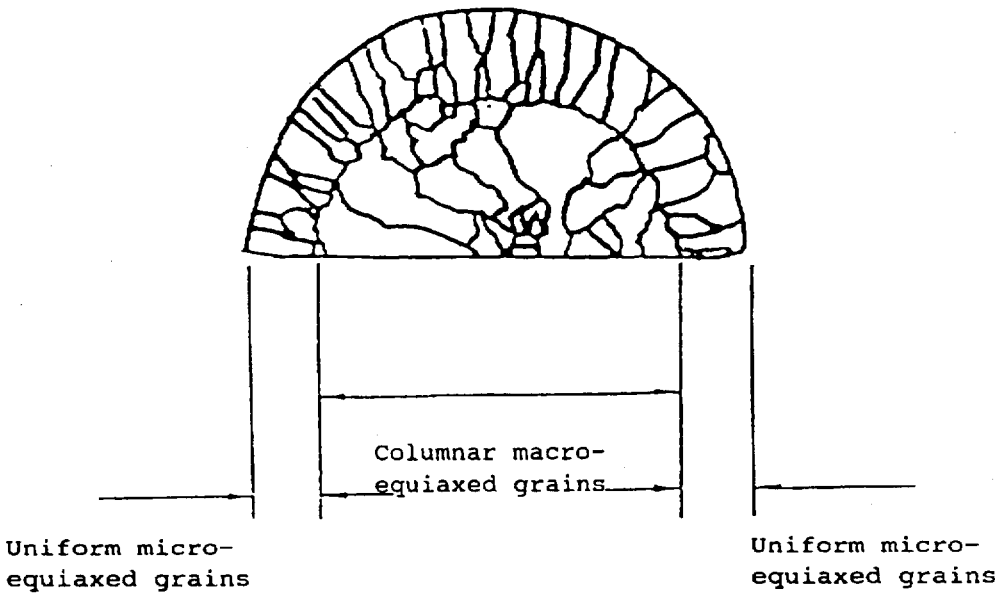
Solidification (half round ingot) structure of 100 mm-dia. Nb ingot top

METHOD OF MANUFACTURING HIGH PURITY REFRACTORY METAL OR ALLOY

[INDUSTRIAL FIELD OF THE INVENTION]

This invention relates to a method of manufacturing, by electron-beam melting, a high-purity refractory metal or its alloy (including intermetallic compound), the refractory metal being selected from the group consisting of niobium, rhenium, tantalum, molybdenum, or tungsten. More particularly, this invention relates to an excellent method of manufacturing the same whereby ingots with less segregation than usual can be made and the material performance (superconductivity characteristics, corrosion resistance, high temperature resistance, etc.) and workability (forgeability, rollability, machinability, etc.) can be markedly improved.

[BACKGROUND OF THE INVENTION]

For the manufacture of refractory metals and their alloys, electron-beam melting method (including Electron Beam Vertical Drip Melt method and Electron Beam Horizontal Trough Melt method; collectively called "EB melting method" hereinafter) has been used. However, much still remains to be studied or to be made clear for the choice and preparation of starting materials, and also about the mechanisms of melting, casting, and solidification in the EB melting process. Also, adequate and thorough evaluation or analysis has not made yet of the values measured as to property of the ingots that result from the melting under those conditions, and it is the present state that refining is performed primarily by thermodynamic volatilization that depends merely on the evacuation capacity of the evacuation system and the molten metal surface area of the EB melting furnace.

The refractory metals thus obtained do not have the properties that they should inherently possess. Moreover, The purity of the refractory metals attained by refining has its limitations and the residual impurity elements present in no small quantities present a problem yet to be clearly solved as to their possible effects on the grain boundary and other characteristics of the products.

An even more important, basic problem is posed by compounds (e.g., oxides, nitrides, carbides, or their complex compounds) that are formed between the molten metal and impurity gaseous or gasifiable ingredient elements such as oxygen, nitrogen, carbon etc. Such gaseous or gasifiable ingredient elements are collectively are herein merely called "gas ingredient elements" for convenience'sake. They are not dissociated or decomposed upon exposure to temperatures far above the melting point of the particular metal undergoing melting; rather, the metal undergoing melting alone rapidly evaporates, resulting in a severe decrease in yield.

The same applies to the case in which the metal contains metal impurities. There exist intermetallic compounds between impurity metal elements and between impurity metal elements and a metal element undergoing melting. Compared with the bonding energy of the metal undergoing melting that is less than one electron volt, the bonding energy of the intermetallic compounds is as much as several eV. From the difference, arises a problem that the intermetallic compounds will not dissociate or decompose at temperatures far above the melting point of a metal to be melted.

The material thus made conventionally by the EB melting method has a coarse cast structure because of a high crystal growth rate and also because of the crystal growth with a considerable thermal gradient inside the cast ingot. Growth of coarse equiaxed grains in the casting skin or surface region is another concomitant phenomenon.

Consequently, the ingot as an aggregate of the coarse grains tends to have grain boundaries with large relative areas. There is another tendency toward the occurrence of the by reaction between the matrix metal and impurity gas ingredient elements along the grain boundaries to form compounds therebetween (oxides, nitrides, carbides, and their complex compounds).

Coarse equiaxed grains develop especially in the casting skin or surface of an ingot, and impurity gas ingredients precipitate or segregate in this portion. Their diffusion reactions give birth to the above compounds between themselves and the matrix metal. These phenomena combinedly reduce the strength, cause fracture (cleavage) in the boundaries during forging or grinding, and deteriorate the machinability of the product.

As for the workability of refractory metals, molybdenum and tungsten in particular, the weakness of their grain boundaries has been pointed out. Although there has been an argument that the weakness is attributable to the influences of such gas ingredients as oxygen and carbon, no convincingly theoretical clarification or solution of the problem has been made yet.

In view of the present situation, tests were conducted to investigate the mechanical properties of grain boundaries of molybdenum. The results are as follows:

(Test 1) A single crystal specimen cut off from a molybdenum ingot made by the EB melting method (melting in the usual manner) was examined by X-ray diffraction. The clarity of Laue spots, the distance between the spots, and the symmetry of the pattern indicated that the single crystal itself is a crystal of very high regularity containing no impurity element.

(Test 2) The surface of a molybdenum ingot made by the EB melting method (melting in the usual manner) was etched away, and a holing test of the grains and grain boundaries (the boundaries sandwiched between two crystals and triple points of boundaries surrounded by three crystals) was done using a 0.15 mm-dia. drill. The inside of the grainy texture was soft enough to permit continuous holing under a small pressure force. The grain boundaries were rough and rugged and permitted only intermittent holing, requiring the application of a high pressure force.

These tests show that there are distinctly different crystal structures or crystal composition regions in the grains and grain boundaries of molybdenum made by the EB melting method (melting in the usual manner). Also, the results of X-ray diffraction testify to the general belief in the art that the group VIa metals such as molybdenum and tungsten do not form much solid solution with impurity elements.

From another different point of view following presumption may be made. Because the single-crystal region is governed by the metallic bond property of molybdenum, its bonding energy is less than one electron volt. In the grain boundary region, there are formed compounds of molybdenum and gas ingredient elements such as oxygen and nitrogen, and carbon. The bonding energy in the latter is largely dictated by the covalent bond, and electrostatic bond too is deemed contributory to some extent, and hence, after all, the bonding energy of several electron volts.

The foregoing presumption leads to a possible conclusion that mechanical working such as forging or rolling can crack at the heterogeneous boundary interface region between the single crystal region of molybdenum with a strong metallic bond property and the compound formed region due to the difference in bonding energy (hardness).

The forging, rolling, or other mechanical working appears to cause hardening due usually to the generation, propagation, and multiplication of dislocations, in addition to the inherent hardness of the material ascribable to its bonding energy. In the case of molybdenum or tungsten, the mechanism of dislocation generation and propagation differs sharply between the above metal-gas compound phase and the metallic matrix phase. Presumably, as a consequence, the heterogeneous boundary region where the two phases meet tends to become a sink of dislocations, which serves as a starting point of multiplication of dislocations. This tendency is strengthened by mechanical working until cracking results. The fractured surface shows cleavage.

Thus, when such a refractory metal as molybdenum and tungsten that has a limited tendency of forming solid solutions with gas ingredient elements solidifies, it is presumed that the impurity gas ingredients precipitate in the boundary region, and the precipitate under heat of an irregular, steep temperature gradient undergoes an interreaction due to diffusion with the molybdenum matrix phase, thereby forming the metal-gas compounds. This is a probable cause of problems including serious deterioration of workability, loss of the favorable properties inherent to the material, and a poor yield despite the formation of ingot blocks.

In the foregoing description the mechanical properties of molybdenum have mainly been dealt with by way of reference. Next, tungsten will be briefly described in comparison with molybdenum. Table 1 compares the physical property values of molybdenum and tungsten.

The comparison of molybdenum and tungsten shows that they both belong to Group VIa of the periodic table and are substantially the same in crystal structure, number of conduction electrons, lattice constant, and atom packing factor. Molybdenum differs, however, from the latter in density (about a half) and melting point.

In the case of niobium for use especially in superconductive cavity accelerators and the like, it is required to have high electric conductivity, thermal conductivity, crystalline ordering and other desirable physical properties. The presence of impurity elements can seriously diminish those properties.

With semiconductive and superconductive materials, the relative residual resistivity (RRR) value is usually used as a measure of high refining. In the case of niobium for superconductive applications, for example, its RRR value is about 1,000 and so in the present state of art the superconductivity is yet to be fully exhibited to the utility level.

As for rhenium, the five elements (inclusive of rhenium) including the afore-described refractory metals are all transition metals. In the periodic table, niobium and tantalum belong to Group Va, molybdenum and tungsten belong to Group VIa, and rhenium belong to Group VIIa. In respect of the crystal structure, niobium, tantalum, molybdenum, and tungsten are BCC and rhenium alone is HCP. Among those metals, rhenium has the high melting point (3453 K) next to tungsten. Its electric resistance is several times greater than that of tungsten and its tensile strength is outstandingly high. Although the mechanism of volatilization refining of the gas ingredient impurities varies with the element, rhenium may be said to be a refractory metal basically similar to molybdenum and the like.

As stated above, while refractory metals thus have some excellent properties, the problem is that their inherent properties have not fully been taken advantage of. Principally responsible for it is the limitations to high purification. As noted above, the correlations between impurity elements and the grain boundaries or various properties mostly remain unsolved. Much more, as for their alloys (including the intermetallic compounds), since the melting and casting of materials with widely different melting points involve, difficulties in compositional control because of a substantial difference in vapor pressure, with a greater possibility of causing segregation and other casting defects are more liable to occur than with single refractory metals.

TABLE 1

Atomic properties of molybdenum and tungsten

| | Atomic Weight | Melt. point °C. | Group | Period | Crystal structure | No. of electron in Conduction band | Lattice constant Å | Density g/cm$^2$ | Packing rate % |
|---|---|---|---|---|---|---|---|---|---|
| Mo | 95.94 | 2610 | VIa | 5 | BCC | 6 | 3.150 | 10.2 | 71.36 |
| W | 183.85 | 3380 | VIa | 6 | BCC | 6 | 3.165 | 19.1 | 71.60 |

As regards the reactivity with other substances, it is known that the electrons in the conduction electron zone contribute to the interactions (reaction and binding) with other substances and that, especially with transition metals such as molybdenum and tungsten, the s-d interaction dominates the bond. From these facts it will be readily understood that molybdenum and tungsten are similar, when their reactivity, for example, with impurity gas-ingredient elements is taken into account.

Next, metals with strong tendencies to form solid solutions (niobium, tantalum, etc.) will be considered. In these metals the residual oxygen, nitrogen, carbon and other gas ingredient impurities are coordinated as interstitial impurities in the regular octahedral position or precipitated in the grain boundary region.

[OBJECT OF THE INVENTION]

This invention aims at solving the problems of the prior art through improvements in the physical and mechanical properties of the refractory metal materials by high purification and also through improvements in their plastic workability by control of the cast structure. The improvements to be achieved are: in the physical properties (superconductivity characteristics, electric properties, thermal conductivity, crystalline ordering, etc.) of niobium by high purification; in the workability (forging, rolling, etc.) and resistance to heat and corrosion of molybdenum and tungsten by high purification; and in the workability (forging, rolling, etc.) and corrosion resistance of niobium, tantalum, and rhenium by high purification and also in their workability (forging, rolling, etc.) by control of the solidification structure.

This invention is intended to achieve an improved volatilization refining effect by simultaneous evaporation, in the form of a nonstoichiometric compound, of impurity metals and gaseous or gasifiable impurities including carbon, nitrogen, oxygen, hydrogen, sulfur, and phosphorus, of such levels that have believed incapable of being refined by volatilization from the viewpoint of thermodynamic equilibrium because of the impurity concentrations in the starting materials and the capacity limitation of the evacuation system of the furnace to be used. The invention is thus directed to raise strikingly the limit of removal by separation of impurities, and reducing the residual amounts of impurity gas ingredient elements and all metallic impurity elements, other than refractory metals, to 50 ppm or less each.

Further, this invention contemplates superhigh purification of materials and control of the solidification structure, and also improvements of workability through inhibition of intergranular fracture, and attainment of the physical and mechanical properties inherent to the materials through superhigh purification.

[SUMMARY OF THE INVENTION]

After intensive research on the above objects, we have now found an excellent method of manufacturing high-purity refractory metals or alloys based on the refractory metals and have perfected the present invention.

In a first aspect, this invention provides a method of manufacturing a high-purity refractory metal or a refractory metal based alloy, said refractory metal being selected from the group consisting of niobium, rhenium, tantalum, molybdenum, and tungsten, comprising the steps of compacting a mixed material, in the form of powders or small lumps, of a refractory metal or alloy to be refined together with one or two or more additive elements selected from the group of transition metal elements consisting of vanadium, chromium, manganese, iron, cobalt and nickel, and from the group of rare earth elements, sintering the resulting compact at a high temperature of at least 1000° C. and a high pressure of at least 100 MPa, and thereafter electron-beam melting the sintered body.

It is preferable that the amount of the additive element or elements has an upper limit of 3% by weight.

It is even preferable that the amount of the additive element or elements has an upper limit of 1% by weight.

In a preferable manner, said mixed material in the form of powders or small lumps to be melted for refining are subjected to CIP and then to HIP at high temperature and pressure of 1000° C. and 100 MPa, and thereafter electron-beam melted.

In a second aspect, this invention provides a method of manufacturing a high-purity refractory metal or a refractory metal based alloy, said refractory metal being selected from the group consisting of niobium, rhenium, tantalum, molybdenum, and tungsten, comprising the steps of compacting a mixed material, in the form of powders or small lumps, of a refractory metal or alloy to be refined together with one or two or more additive elements selected from the group of transition metal elements consisting of vanadium, chromium, manganese, iron, cobalt and nickel, and from the group of rare earth elements, sintering the resulting compact at a high temperature of at least 1000° C. and a high pressure of at least 100 MPa, thereby forming a lower compound or nonstoichiometric compound between at least a part of the additive element or elements and the impurity gas ingredient elements, such as oxygen O, nitrogen N, carbon C, and hydrogen H, contained in the refractory metal or alloy to be refined, and thereafter electron-beam melting the sintered body. It is to be noted that such gaseous or gasifiable ingredient elements are collectively are herein merely called "gas ingredient elements" for convenience'sake.

In the above second aspect, the lower compound or nonstoichiometric compound is desirably $Me_{1-x}Ga$ ($0 \leqq x < 1$) where Me is an element or elements selected from the group transition metal elements consisting of vanadium, chromium, manganese, iron, cobalt and nickel or from the group of rare earth elements, and Ga is impurity gas ingredient elements such as O, N, C, and H.

In the above second aspect, the lower compound or nonstoichiometric compound formed by sintering at high temperature and pressure may be removed by vaporization refining during the electron-beam melting.

In the above method, it is also preferable that the amount of the additive element or elements has an upper limit of 3% by weight.

In the above method, it is also even preferable that the amount of the additive element or elements has an upper limit of 1% by weight.

In a preferable manner of the second aspect, said mixed material in the form of powders or small lumps to be melted for refining are subjected to CIP and then to HIP at high temperature and pressure of 1000° C. and 100 MPa, and thereafter electron-beam melted.

In a preferable illustration of this invention, the refractory metal is niobium or an alloy based thereon and has a Vickers hardness $Hv \leqq 60$ and a relative residual resistivity (RRR) value of at least 1000.

In another preferable illustration of this invention, the refractory metal is rhenium, tantalum, or an alloy based thereon.

In a further preferable illustration, the refractory metal is molybdenum, tungsten, or an alloy based thereon.

In this invention, the additive element or elements may be one or two or more elements selected from the group consisting of transition metal elements.

Typically, the additive element is iron.

In the method of this invention, amounts of the residual impurity gas ingredients may be such that oxygen $O \leqq 50$ ppm, nitrogen $N \leqq 50$ ppm, and carbon $C \leqq 50$ ppm.

Preferably, the total amount of the residual impurity gas ingredient elements is such that $O+N+C \leqq 100$ ppm.

[BRIEF EXPLANATION OF THE DRAWINGS]

FIG. 1 is a schematic view of a compact made by pressing materials.

FIG. 2 is a view explanatory of how the Vickers hardness is measured.

FIG. 3 is a graph showing the relation between the temperature (K) and electric resistance of 40 mm-dia. high purity Nb ingots.

FIG. 4 is a graph showing the relation between the temperature (K) and relative residual resistivity (RRR) of 40 mm-dia. high purity Nb ingots.

FIG. 5 is a graph showing the relation between the number of melting and relative residual resistivity (RRR) of 40 mm-dia. high purity Nb ingots.

FIG. 6 is a graph showing the relation between the number of melting and relative residual resistivity (RRR) of 40 mm-dia. high purity Nb ingots.

FIG. 7 is a graph showing the relation between the Vickers hardness and relative residual resistivity (RRR) of 40 mm-dia. high purity Nb ingots.

FIG. 8 is a graph showing the relation between the temperature (K) and electric resistance of 100 mm-dia. high purity Nb ingots.

FIG. 9 is a graph showing the relation between the temperature (K) and relative residual resistivity (RRR) of 100 mm-dia. high purity Nb ingots.

FIG. 10 is a diagrammatic view of the solidification (half round ingot) structure of a 100 mm-dia. high purity Nb ingot top.

[DETAILED EXPLANATION]

The details and function of this invention will be described below.

(Preparation of starting materials)

A mixed material in the form of powders or small lumps (powders, chips, scraps, etc.) of a refractory metal to be refined which is metallic niobium, rhenium, tantalum, molybdenum, or tungsten or an alloy based thereon (purity about 99–99.9%), together with one or two or more additive elements selected from the group of transition metal elements consisting of vanadium, chromium, manganese, iron, cobalt and nickel or from the group of rare earth elements is compacted in advance by pressing.

Next, the compact is sintered at a high temperature of at least 1000° C. and a high pressure of at least 100 MPa.

For the compaction by pressing, CIP (cold isostatic pressing) may be used. For the high-temperature, high-pressure sintering, HIP (hot isostatic pressing) is suitably used.

This procedure promotes to cause the reaction between the impurity gas ingredient elements, such such as O, nitrogen N, carbon C, and hydrogen H contained in the refractory metal material to be refined and one or two or more additive elements selected from the group of transition metal elements consisting of vanadium, chromium, manganese, iron, cobalt, and nickel or from the group of rare earth elements to form a lower compound or nonstoichiometric compound $Me_{1-x}Ga$ (where $0 \leqq x < 1$, Me is one or two or more transition metal elements or rare earth elements selected from the group consisting of vanadium, chromium, manganese, iron, cobalt, and nickel or of rare earth elements, and Ga is impurity gas ingredient elements, such as O, N, C, and H,). The transition metal or rare earth element or elements, of course, include those contained as impurities in the refractory metal or alloy material to be refined, if any.

The sintering (including HIP) at a high temperature of at least 1000° C. and a high pressure of at least 100 MPa is intended to ensure composition of the lower compound or nonstoichiometric compound $Me_{1-x}Ga$, inducing the transformation from the stoichiometric to nonstoichiometric composition at elevated temperature and pressure and thereby enhancing the refining effect of the EB-melting.

The effective amount of the transition metal element or elements to be added of vanadium, chromium, manganese, iron, cobalt, and nickel or of the rare earth element or elements, either singly or in combination, has an upper limit of 3% by weight. The amount is preferably 1% or less by weight where there is the possibility of such an element or elements remaining as impurities. There is no special need of setting the lower limit, but an effective amount is at least 0.001% by weight, preferably 0.01 to 0.1% by weight or more. This proportion may vary with the particular refractory metal material to be refined.

When such additive element or elements of transition metals or rare earth elements constitutes the alloying element of an refractory metal alloy based on niobium, rhenium, tantalum, molybdenum, or tungsten, the additive element or elements are added in an amount exceeding that to be contained in the alloy composition, and the composition is adjusted so that an adequate refining effect can be eventually achieved while attaining a proper alloy composition.

The additive element or elements can enhance, besides the thermodynamic refining effect, a refining effect taking the advantage of lowered dissociation temperature and vapor pressure differential. The use of a transition metal element or elements is particularly economical and effective. Above all, the addition of iron is most effective in forming a lower or nonstoichiometric compound and in removing impurity gas ingredients by EB melting. A sintered body made in this step is employed as a primary electrode for EB melting.

(Melting conditions)

EB belting is performed by the electron beam vertical drip melting or electron beam horizontal trough melting technique using the above primary electrode. Usually, multiple melting (several to over ten times) is carried out.

For example, an ingot obtained by the electron beam vertical drip melting method is cut off from the starting block, cleaned of contaminants such as oil and grease, e.g., by ultrasonic washing, and melted, and then melting is repeated several times.

The EB melting conducted in the manner described accomplishes volatilization refining and thereby removes the lower compound or nonstoichiometric compound formed at the time of sintering, and yields a refractory metal or an alloy based thereon with an extremely high purity.

When the refractory metal is niobium or an alloy based thereon, a Vickers hardness Hv of $\leqq 60$ and an RRR value of at least 1000 are attained, and it becomes possible to limit the amounts of the residual impurity gas ingredient elements to 50 ppm or less each, the combined amount of O, N, and C being no more than 100 ppm ($O+N+C \leqq 100$ ppm).

(Method of electric resistance measurement (calculation of RRR value) and preparation of specimens)

Each test specimen for electric resistance measurement is a circular disk about 5 mm thick cut out of the center of an ingot obtained, e.g., by multiple EB melting, and cut precisely to be a quadrangular prism measuring about 5 mm×3 mm×21 mm using a precision cutter.

A measuring circuit consists of a constant-voltage, constant-current supply source, micrometer, ammeter, standard resistor, toggle switch for current polarity inversion, and four terminals. Specimens are brought into ohmic contact with a four-terminal probe under pressure, and, in constant-current modes of 100 mA, 500 mA, and 700 mA of current supplied by the constant-voltage, constant-current source for a given period of time, measurements are made of the temperature, current, and voltage. The constant current is immediately switched off, and one minute later the temperature, current, and voltage are measured. The four terminals carrying the current and voltage are kept about four meters apart to keep the field gradient constant. The measurement temperature ranges from room temperature to about 10 K.

(Measurement of Vickers hardness)

For the mechanical evaluation and purity comparison, the test specimens after the electric resistance measurement are subjected to a Vickers hardness test. The load applied is 10 kg and the loaded time is 15 sec. for all the specimens tested. Measurement is taken at three points of each specimen as shown in FIG. 2 and the arithmetic mean of the three values is taken as the Vickers hardness of the specimen.

[EXAMPLES]

The present invention is illustrated by the following examples.

Example 1

Starting materials

As starting materials, a uniformly mixed powder of a powdered niobium (#325) with a purity of about 2N (99%) to 3N (99.9%) and an electronic iron powder on the outer side and the same Nb power packing the inside were formed by CIP into a compact of double structure (see FIG. 1). The compact was then filled in a capsule of mild steel and HIP processed under the conditions of 1350° C. and 140 MPa for 180 sec.

After the HIP processing, the mild steel capsule was cut off on a lathe to make a primary electrode for EB melting. The electrode measured 40 mm in diameter and 220 mm long.

Melting conditions

Primary electrodes thus made were subjected to multiple (10 times) melting by EB-vertical drop melting (EB-VDM). The melting conditions used are shown in Table. 2.

During the series of 10 melting runs, an about 5 mm-thick disks were cut out of the center of the ingot after each of the first, fourth, seventh, and tenth runs. The disks thus obtained (designated 1M, 4M, 7M, and 10M, respectively) served as specimens for various analyses. Specimen Nos. S1 and S2 indicate series used for gun outputs of 31.5 kW and 42.5 kW, respectively.

TABLE 2

Nb melting conditions for EB vertical drip melting

| | |
|---|---|
| Melting method | EB vertical drip melting (EB-VDM) |
| Beam shape | Opposite semicircular |
| Beam scanning | Fixed |
| Electrode speed | 58.3 rpm |

| Specimen No. | Gun output | Melting number | Sampling point | HIP proce'd | Metal added |
|---|---|---|---|---|---|
| S1 series | 31.5 kW | 1–10 times | 1, 4, 7, 10 | yes | Fe |
| S2 series | 42.5 kW | 1–10 times | 1, 4, 7, 10 | yes | Fe |

Results of chemical analysis

Table 3 summarizes the analytical results of impurity elements with different numbers of melting runs. It clearly indicates that the amounts of various impurities decrease as the number of melting increases. As exemplified, here, the ingots that started with Nb with the addition of Fe and experienced multiple melting after HIP processing achieved striking degrees of purification. The volatilization removal effect accomplished of the impurities mainly of gas ingredient elements is amazing. Although iron was used as an additive element in this example, similar beneficial effects were observed with other elements of rare earths as well as of transition metals such as vanadium, chromium, manganese, cobalt, and nickel.

TABLE 3

Chemical analysis of superhigh purity Nb specimens

Unit : ppm

| Specimen | O | N | C | H | S | Fe | Mo | Ta | W |
|---|---|---|---|---|---|---|---|---|---|
| Starting material | 3000 | 40 | 50 | 20 | — | 50 | <100 | 900 | <100 |
| S1 - 1M | 930 | 20 | <10 | 8 | <0.05 | 21 | 10 | 1100 | 23 |
| S1 - 4M | 23 | <10 | <10 | 2 | <0.05 | 0.39 | 13 | 1600 | 32 |
| S1 - 7M | <10 | <10 | <10 | 2 | <0.05 | 0.032 | 12 | 1500 | 32 |
| S1 - 10M | <10 | <10 | <10 | <1 | <0.05 | 0.029 | 7 | 1100 | 22 |
| S2 - 1M | 780 | 20 | <10 | 7 | <0.05 | 440 | 6 | 850 | 18 |
| S2 - 4M | 20 | <10 | <10 | 9 | <0.05 | 1 | 7 | 990 | 21 |
| S2 - 7M | <10 | <10 | <10 | 3 | <0.05 | 0.034 | 8 | 1100 | 25 |
| S2 - 10M | <10 | <10 | <10 | <1 | <0.05 | 0.033 | 7 | 1100 | 21 |

The above effects of removing impurities such as gas ingredient elements have remarkable effects on the superconductivity characteristics and hardness of the product. Results of electric resistance and hardness measurements will be given below.

Preparation of specimens and measurement of electric resistance (calculation of RRR value)

As test specimens of Nb stocks for electric resistance measurement, about 5 mm-thick discs were cut out from the centers of the Nb ingots obtained by multiple EB melting, after the first, fourth, seventh, and tenth melting runs. They were further cut from the peripheries inwardly to form quadrangular prisms each measuring about 5 mm×3 mm×21 mm.

Each specimen was polished on the surface with SiC emery paper #320 and then #500 to remove the deformed layer that had resulted from the cutting and also to prevent current disturbance on the surface.

For the measurement of resistivity the ordinary four-terminal method was used. In constant-current modes of 100 mA, 550 mA, and 700 mA of current supplied by a constant-voltage, constant-current source for a given period of time, measurements are made of the temperature, current, and voltage. The constant current was immediately switched off, and one minute later the temperature, current, and voltage were measured.

As for a thermocouple, a Cu-0.15% Fe-chromel thermocouple was used. For the rise and fall of the measurement temperature a refrigerator manufactured by Janice (phonetic) was employed. The measurement temperature ranged from room temperature to about 10 K, and a continuous measurement method was used for both temperature increase and decrease.

Results of electric resistance measurement

FIG. 3 shows typical results of electric resistance measurement of specimens obtained by melting in this example of this invention. The standard resistance is plotted in the form of natural logarithms as ordinate and the temperature as abscissa.

In FIG. 3, the symbols ▽ and Δ indicate the resistance values measured during temperature fall and the resistance values measured during temperature rise, respectively. The symbol ○ indicates the averaged resistance values by optimum curve approximation. The electrical resistivity is expressed as a linear function relative to temperature up to about 100 K (=θD/3 where θD is the Debye temperature) and, below about 100 K, it can be approximated by the rule of fifth power of temperature.

Nb is a superconductive material of the first kind, and its superconductive transition (where the electric resistance becomes zero) occurs at 9.2 K. At temperatures below 10 K, therefore, the relative residual resistivity can hardly be found by the electric resistance method. Although there is a method of finding the ratio while the superconductive state is broken down by the application of a magnetic field, the specimens herein were evaluated using the comparatively easier method of electric resistance measurement to obtain the relative residual resistivity. Since the capacity of the refrigerator set the ultimate minimum temperature at 20 K, the numerical values (of electric resistance and relative residual resistivity) at temperatures below 20 K were determined by approximating the electric resistance to the quinary function of the temperature on the basis of the actually measured values at from room temperature up to 20 K, and the numerical values below 20 K (up to 10 K) were calculated from the optimum function. Similar techniques are used hereinafter for the determination of the electric resistance and relative residual resistivity.

As will be obvious from FIG. 3, the measured values of electric resistance during temperature fall and those during temperature rise are almost in complete agreement, very close to the electric resistance inherent to the materials. Generally, every specimen shows the electric resistance due to lattice vibration in conformity with Mattiessen's rule down to 100 K (=Debye temperature of Nb/3), and shows the electric resistance due to the scattering of electrons from mechanical defects and residual impurities in the temperature region below about 100 K. The specimens in this example of this invention indicate a decrease in electric resistance also in the temperature region below 20 K which indicates increased degree of high purification, and markedly enhanced long-range ordering of the crystal.

FIG. 4 shows typical analytical results of RRR values expressed as the function of temperature relative to temperature. The abscissa is the measurement temperature T (K) and the ordinate is the natural logarithm of RRR values as the function of temperature RRR (T). The symbols ▽, Δ, and ○ indicate the actually measured values of resistance during temperature fall and rise and their averaged values by optimum curve approximation, respectively.

As FIG. 4 shows, the slope of RRR (T) as a function of temperature in the region below 60 K is very sharp. This indicates very high long-range ordering of the crystal as well as high purification, as noted already in connection with FIG. 3.

The term RRR (T) denotes the value obtained by dividing the electric resistivity at the temperature 293 K, ρ (239 K), by the electric resistivity at the temperature T, ρ (T), i.e., RRR (T)=ρ (239 K)/ρ (T). Both Table 4 and FIG. 5 show RRR (10 K) values, i.e., RRR (T) values at T=10 K.

TABLE 4

Analysis of relative residual resistivity (RRR) values of test specimens

| Specimen No. | RRR during temp. fall | RRR during temp. rise | RRR average |
|---|---|---|---|
| S1-1 | 50 | 50 | 50 |
| S1-4 | 3,800 | 3,700 | 3,750 |
| S1-7 | 8,700 | 8,500 | 8,600 |
| S1-10 | 10,000 | 10,000 | 10,000 |
| S2-1 | 20 | 20 | 20 |
| S2-4 | 2,500 | 2,200 | 2,350 |
| S2-7 | 5,700 | 5,500 | 5,600 |
| S2-10 | 10,000 | 10,000 | 10,000 |

Table 4 shows the relative residual resistivity values during temperature fall and temperature rise and their average values. In FIG. 5 the symbol ○ designates the data about Nb of the S1 series, □ the data of the S2 series, and ◇ the data about Nb made by the prior art (of the former Soviet Union who claimed the world's top in the manufacture of medium-size ingots by EB melting).

As is clear from Table 4, four melting runs brought the RRR value (average) of the specimen S2-4 to 2350 and that of S1-4 to 3750. Also, as FIG. 5 shows, on the fourth run and afterwards the RRR values increased gradually. It will be seen too that there is a correlation between the melting and casting velocities and the refining effect and the faster the melting and casting the less the volatilization refining effect.

A stock (Nb) after the addition of iron was melted 10 times without prior sintering at elevated temperature and pressure (but otherwise under the same conditions) in conformity with this invention, and the RRR values of the specimen were studied. In this case the remarkable results as mentioned above were not obtained, the RRR value being at most about 300. This demonstrates the important significance of sintering at high temperature and pressure.

From the foregoing it is presumed that, in the process of sintering under the high-temperature, high-pressure conditions of HIP, transition metal or the like and gas-ingredient impurities form lower or nonstoichiometric compounds, which evaporate during EB melting, in a state of a lowered temperature of dissociation from the refractory metal being refined and of an unusually high volatilization rate because of some mechanism other than a simple thermodynamic mechanism of volatilization refining, whereby markedly high refining is accomplished.

Measurement of Vickers hardness

For the mechanical evaluation and the comparison in purity of test specimens, the specimens after the electric resistance measurement were used for a Vickers hardness test.

The load applied was 10 kg and the loaded time was set to 15 sec. for all the specimens tested. Measurement was taken at three points of each specimen as shown in FIG. 2, and the arithmetic mean of the three values was taken as the Vickers hardness of the specimen. The Vickers hardness values determined this time do not conform to the procedure specified in JIS-Japanese Industrial Standard-(the specimen surface should be as-rough polished rather than mirror-polished) and the values of the Vickers hardness test conducted are apparently several percent lower than those according to the JIS test.

Results of Vickers hardness test

FIG. 6, shows the results of Vickers hardness test and number of melting runs of the same specimens that had finished electric resistance measurement. The symbol ○ represents the S1 series and □ represents the S2 series.

The graph reveals the tendency of the Vickers hardness decreasing with the frequency of melting, especially on and after the fifth melting run. The results of hardness measurement suggest a rapid improvement of workability. From the correlation between the frequency of melting and hardness it is obvious that a desirable number of melting runs is four or more.

Results of comparative study of RRR and Vickers hardness values

FIG. 7 shows the results of comparison between RRR and Vickers hardness values. The abscissa is Vickers hardness and the ordinate is RRR value ($\rho(239\ K)/\rho(10\ K)$). FIG. 7 suggests a correlation between the two, indicating that the RRR value increases relatively moderately in the hardness range of 60–140 but increases sharply from 60 downward.

The fact stated above implies that there is a different energy absorption mechanism, e.g., beyond Hv=about 60. It may be supposed that Hv=about 60 is a certain transition point (the limit up to which the impurity gas ingredient elements in an Nb material, e.g., oxygen and nitrogen, can form solid solutions with Nb). Then the oxygen and nitrogen as the impurity gas elements in the Nb material, specifically the portions of the impurity gas elements other than the interstitial solid solution concentrations of oxygen and nitrogen in the region above the solid solution limit of Nb, would presumably have to segregate in the grain boundaries to form inter-element compounds or, conversely in the region below the transition point, the impurity gas ingredient elements such as oxygen and nitrogen would be coordinated as interstitial impurities in the regular octahedral positions in the grains.

Considering the relationship between the impurity concentrations and Vickers hardness in the above presumption, it follows that, above Hv=about 60, the regular octahedral positions as interstitial sites of grains are all occupied by the impurities and the rate of changes in the grains remains unchanged. What differs in the rate is only the grain boundary width (the thickness of the inter-element compound resulting from segregation and diffusion). Thus the load energy for the hardness test is consumed by the grain boundary distortion energy. The change at that time seems to be great enough to be recorded as an indentation of the Vickers hardness.

In the case of an inter-element compound the bonding energy is as much as several electron volts, and the percentage of consumption for the deformation in the boundaries relative to a given amount of load energy is presumably small. It will then be understood that a moderate increase in RRR value occurs above the transition point.

On the other hand, below the transition point, the grain boundaries do not contain sufficient amounts of oxygen and nitrogen to synthesize inter-element compounds. Carbon alone slightly occurs in the boundaries, but the metal-gas ingredient element compound formed by the carbon has superconductivity characteristics in itself and does not influence the RRR value. Also, the regularity of the crystal is presumably enhanced by decreases in the solid solution degrees of oxygen and nitrogen in the crystal, until the characteristics values approach those peculiar to the material itself.

The BCC crystal of Nb occupied by the solid solution type impurities may be taken as a metallic bond. Since the bonding energy in this case is one electron volt or less, the rate of change of energy attributable only to the rate of deformation of the crystals relative to a given load energy becomes high.

Compared with the analysis of gas-ingredient impurities in Table 3, the rate of removal of carbon atoms with melting runs is low in the region of Hv>60 and no substantial decrease in hardness takes place. In the region of Hv>60 where the influence of the carbon atoms on bonding is decreased, it is presumed that the sharp rise of the RRR value resulted from extreme removal of oxygen and nitrogen atoms.

In the prior art intergranular fracture surfaces are faceted, which in turn seriously affects the workability of the stocks (tending to induce more intergranular fracture). As will be manifest from the comparison of the RRR value and Vickers hardness in this example, substantial decreases in the proportions of impurities such as oxygen, nitrogen, and carbon in an Nb stock facilitate the working. It will also be readily understood that the above-mentioned form of fracture can be prevented and the workability be markedly improved by proper choice of both the segregation sites of those impurities in the grains and boundaries and their forms of combination with the Nb material.

From the above it may be concluded that the novel EB melting method of this invention is excellent for the manufacture of an ingot having grain boundaries with good workability and also an ingot having the physical properties inherent to the material itself owing to the fact that it is free from any interstitial impurities in the regular octahedral position in the crystal.

Example 2

Starting materials

As starting materials, a uniformly mixed powder of a powder (#325) of niobium with a purity of about 2N–3N and an electronic iron powder (about 1 wt %) were packed into a compact, subjected to CIP in the manner described in Example 1, and the resulting compact was filled in a capsule of mild steel. It was then HIP processed under the conditions of 1350° C. and 140 MPa for 180 sec.

After the HIP processing, the mild steel capsule was cut on a lathe to make a primary electrode for EB melting. The electrode measured 100 mm in diameter and 300 mm long.

Melting conditions

Primary electrodes thus made were subjected to four-time melting by the EB-VDM method. After the fourth melting run, disks about 5 mm thick were cut off from the top and lower portions of the ingot and used as test specimens for various analyses and evaluations. The melting conditions used are shown in Table 5.

Results of chemical analysis

Table 6 summarizes the analytical results of the ingot obtained in Example 2. Table 6 demonstrates improved effects of removal of impurity gas ingredients, especially of oxygen, over the effects (Table 3) of Example 1.

The melting conditions used in Examples 1 and 2 were not necessarily the same. A noticeable difference was that whereas Example 1 used an electrode made by HIP processing of a compact of Nb as a starting material thoroughly mixed with 1 wt % iron only in the annular region 10 mm thick (see FIG. 1), Example 2 used an electrode of Nb as a starting material uniformly mixed with 1 wt % iron throughout and then HIP processed. In brief, the iron dispersed and mixed in this way (the uniform mixture having a higher rate of forming a nonstoichiometric compound) presumably had a beneficial effect upon the removal of impurities. In either case, the examples of this invention testify to the substantial improvement in the impurity removal effect over the prior art.

As is clear from Table 6, only the gravity segregation of Mo, Ta, and W occurred in the upper and lower portions of the ingot, and the segregation of other impurities was surprisingly small for an ingot of such a large size.

TABLE 5

100 mm-dia. Nb ingot melting conditions for EB-VDM

| Melting method | EB vertical drip melting | Gun output | 31.5 kW |
|---|---|---|---|
| Beam shape | opposite semicircular | Melt freq | 4 times |
| Beam scanning | fixed | Sampling | after 4th |
| Electrode speed | 58.3 rpm | HIP | yes |
| | | Metal added | Fe |

TABLE 6

Chemical analysis of 100 mm-dia. high purity Nb ingot

| Specimen | O | N | C | H | S | Fe | Mo | Ta | W |
|---|---|---|---|---|---|---|---|---|---|
| Start. mat | 3000 | 40 | 50 | 20 | — | 50 | <100 | 900 | <100 |
| Upper av | <10 | <10 | 13 | 1 | <0.05 | 0.12 | 16 | 1044 | 30 |
| Lower av | <10 | <10 | 12 | 1 | <0.05 | 0.16 | 44 | 1550 | 62 |
| Ingot av | <10 | <10 | 13 | 1 | <0.05 | 0.14 | 30 | 1297 | 46 |

To evaluate the superconductivity characteristics and mechanical properties of the 100 mm-dia. Nb ingot obtained in Example 2, the same electric resistance measurement, RRR value analysis, and Vickers hardness (Hv) test as described in Example 1 were performed. The results are shown in FIGS. 8 and 9 and in Table 7.

Vickers hardness (Hv) was measured at two upper and two lower points of each of the three sides of the ingot, i.e., the resistivity measurement side, the side perpendicular to that side, and the opposite side. The averages of the measured values are also given. The overall average was Hv=50.2. In the prior art Hv usually ranges from 100 to 130 and even that of the ingot claimed to be of high purity is about 85. This means that the decrease in hardness (improvement of workability) in this example is outstanding. Another feature is that, large as it is, the ingot shows little difference in hardness between its upper and lower portions.

TABLE 7

Vickers hardness measurements of 100 mm-dia. high purity Nb
Load = 10 kg
Time = 15 sec

| Test specimen | Vickers hardness: Perpendicular to resistance measure side | Resistance measurement side | Side opposite to resistance measure side |
|---|---|---|---|
| Upper portion average | 50.4 | 51.1 | 51.5 |
| Lower portion average | 47.2 | 49.6 | 51.4 |

TABLE 7-continued

Vickers hardness measurements of 100 mm-dia. high purity Nb
Load = 10 kg
Time = 15 sec

| Test specimen | Vickers hardness: Perpendicular to resistance measure side | Resistance measurement side | Side opposite to resistance measure side |
|---|---|---|---|
| Overall ingot average | | 50.2 | |

Electric resistance measurement

FIG. 8 shows typical results of electrical resistance measurement of the test specimen obtained by melting in this example. The data are plotted, with the standard values of resistance in terms of natural logarithm as ordinate and the temperature as abscissa. The symbol ○ indicates the averages of the resistance values measured during temperature fall and rise. The electrical resistivity is expressed as a linear function relative to temperature up to about 100 K (=θD/3 where θD is the Debye temperature) and, below about 100 K, it can be approximated by the rule of fifth power of temperature.

As FIG. 8 clearly indicates, the electric resistance at temperatures in the region below 60 K decreases sharply. Also, a comparison between FIGS. 8 and 3 reveals that the electric resistance of the specimen after four melting runs of Example 2 is substantially equal to that of the specimen after 10 runs in Example 1. This presumably suggests, as with the above chemical analysis, the dispersed and mixed state of iron in the compact before melting and also the sintering (HIP) conditions (the uniform mixture having a higher rate of forming a nonstoichiometric compound) had a beneficial effect upon the removal of impurities.

FIG. 9 shows typical analytical results of RRR values expressed as the function of temperature relative to temperature. The abscissa is the measurement temperature T(K) and the ordinate is the natural logarithm of RRR values as the function of temperature RRR (T). The symbol ○ indicates averages of the actually measured values of resistance during temperature fall and rise.

As FIG. 9 shows, the slope of RRR (T) in this example as a function of temperature in the region below 60 K is very sharp. This is presumably attributable to the fact that the nonstoichiometric (lower) compounds, formed by the addition of iron to the impurity gas ingredient elements such as oxygen, nitrogen, and carbon that had been contained in the starting material, achieved a surprisingly favorable effect in the volatilization refining by EB melting. Thus the specimens of this example were highly refined and exhibited very high long-range ordering of the crystal.

The specimens taken from the lower and upper portions of the ingot all had RRR values over about 10,000 and hardness values of 45<Hv<60, like the ingot melted 10 times in Example 1. The results demonstrate the great physical volatilization refining effect of the nonstoichiometric compounds formed by the addition of iron.

As is evident from Examples 1 and 2, the presence of a refining mechanism other than a simple volatilization refining effect is observed when iron is added to an ingot in an amount large enough to form (lower) nonstoichiometric compounds and the ingot is HIP processed and then used as an electrode for EB melting.

With regard to the number of melting, it is to be noted that even a single melting can achieve amazingly high refining because if the impurity ingredients in the starting materials (the gas impurity ingredient elements being of particular importance) are known, iron or other suitable additive element enough to form nonstoichiometric compounds (and lower compounds) can be added.

FIG. 10 shows a solidification structure of the top of an ingot (half round ingot) obtained in this example of the invention. It has been known in the art that, when a refractory metal is EB melted, the resulting cast structure is composed of very coarse equiaxed grains from the zone close to the casting surface inwardly, with the inside formed of a columnar crystals in the casting direction. Ingots having such a conventional cast structure are prone to fracture starting with the grain boundaries upon forging, rolling, or lathe working.

According to this invention, the high purification eliminates the impurities that would cause nucleation during solidification, and thereby permits uniform grain formation throughout to obtain a uniform, regular solidification structure. It will be seen from FIG. 10 that columnar macroequiaxed grains are formed inside and uniform microequiaxed grains outside.

The uniform microequiaxed grains on the outer periphery are equiaxed grains in the form of generally rectangular wedged plates or pieces, standing face to face, in the peripheral portion about 15 mm deep from the casting surface inwardly. They form a structure which plays a wedge-like role when the ingot is forged, rolled, or machined with a lathe, and is capable of dispersing the pressures applied from the outside. This structure avoids uneven burdening of load during working and constitutes a factor in the material improvement in workability of the ingot.

Example 3

Starting materials

One percent by weight of iron was added to each of Mo, W, Ta, and Re powders with purity of 2N (99%) listed in Table 8. Further, to additional five Re powders, 0.1 wt % Ni, 0.7 wt % Co, 1.5 wt % Cr, 2.5 wt % Mn and 1.2 wt % Y were added, respectively. Those combinations were uniformly mixed and, under the same conditions used in Example 2, electrodes for EB melting were fabricated.

Melting conditions

The melting conditions of Mo, W, Ta, and Re are also given in Table 8. The number of melting was four times for Ta-1 and twice for the rest.

TABLE 8

Melting conditions for various ingots having 40 mm diameter × 200 mm length

| Specimen No. | Metal type | Material form | Purity | Electrode | Additive | Q'ty added | Melt freq | Melting method |
|---|---|---|---|---|---|---|---|---|
| Mo-1 | Mo | powder | 2N | HIP'd | Fe | 1 wt % | twice | EB-VDM |
| W-1 | W | " | " | " | " | " | " | " |
| Ta-1 | Ta | " | " | " | " | " | four | " |
| Re-1 | Re | " | " | " | " | " | twice | " |
| Re-2 | " | " | " | " | Ni | 0.1 | " | " |
| Re-3 | " | " | " | " | Co | 0.7 | " | " |
| Re-4 | " | " | " | " | Cr | 1.5 | " | " |
| Re-5 | " | " | " | " | Mn | 2.5 | " | " |
| Re-6 | " | " | " | " | Y | 1.2 | " | " |

Results of chemical analysis and workability evaluation

The results of chemical analysis and workability and corrosion resistance evaluation tests of Mo, W, Ta, and Re are given, in comparison with comparative examples, in Tables 9, 10, 11, and 12, respectively. The specimens of comparative examples did not contain the additives of the present invention and were not HIP processed.

TABLE 9

Mo chemical analysis and machinability

| Test specimen | | Chemical analysis (ppb) | | | Chemical analysis (ppm) | | | | | | | | Intergranular crack | |
|---|---|---|---|---|---|---|---|---|---|---|---|---|---|---|
| No. | made by | U | Na | K | Fe | Co | Ni | Cr | C | O | H | N | Lathe working | Extrusion |
| Mo-1 | This Example twice EB-melted | <1 | <1 | <1 | <0.1 | <0.1 | <0.1 | <0.1 | <10 | <10 | <1 | <10 | ○ | ○ |
| Mo-2 | Comp Example twice EB-melted | <20 | 3000 | 4000 | 3 | 1.5 | 2.7 | 1.5 | 50 | 35 | <1 | <10 | Δ | X |
| Mo-3 | Comp Example 4 twice EB-melted | <10 | 100 | 100 | 2 | 1.3 | 1.5 | 1.2 | 20 | 10 | <1 | <10 | ○ | Δ |

○ No intergranular cracking
Δ Some intergranular cracking
X Much intergranular cracking

TABLE 10

W chemical analysis and machinability

| Test specimen | | Chemical analysis (ppb) | | | Chemical analysis (ppm) | | | | | | | | Intergranular crack | |
|---|---|---|---|---|---|---|---|---|---|---|---|---|---|---|
| No. | made by | U | Na | K | Fe | Co | Ni | Cr | C | O | H | N | Lathe working | Extrusion |
| W-1 | This Example twice EB-melted | <1 | <1 | <1 | <0.1 | <0.1 | <0.1 | <0.1 | <10 | <10 | <1 | <10 | ○ | ○ |
| W-2 | Comp Example twice EB-melted | <20 | 200 | 300 | 2 | 1.2 | 1.8 | 0.8 | 15 | 35 | <1 | <10 | Δ | X |

○ No intergranular cracking
Δ Some intergranular cracking
X Much intergranular cracking

TABLE 11

Ta chemical analysis and corrosion resistance

| Test specimen | | Chemical analysis (ppb) | | | Chemical analysis (ppm) | | | | | | | | Corrosion resistance | | |
|---|---|---|---|---|---|---|---|---|---|---|---|---|---|---|---|
| No. | made by | U | Na | K | Fe | Co | Ni | Cr | C | O | H | N | Surface change with time | Surface color | Etching property* |
| Ta-1 | This Example 4 times EB-melted | <1 | <1 | <1 | <0.1 | <0.1 | <0.1 | <0.1 | <10 | <10 | <1 | <10 | no (1 y later) | clear white silver | ab. 5 min. |
| Ta-2 | Comp. Example 4 times EB-melted | <1 | 400 | 500 | 2.5 | 1.5 | 2.2 | 1 | 60 | 160 | 8 | <10 | yes (1 w later) | white silver white grey | ab. 2 min |

*Etching was carried out using an ordinary etching solution of fluoric acid:nitric acid:water = 1:1:4 at about 20° C. The time period represents the time elapsed until a macro-structure emerged.

TABLE 12

Re chemical analysis and machinability

| Test specimen | | Chemical analysis (ppb) | | | Chemical analysis (ppm) | | | | | | | | Intergranular crack | |
|---|---|---|---|---|---|---|---|---|---|---|---|---|---|---|
| No. | made by | U | Na | K | Fe | Co | Ni | Cr | C | O | H | N | Lathe working | Extrusion |
| Re-1 | This Example twice EB-melted | <1 | <1 | <1 | <0.1 | <0.1 | <0.1 | <0.1 | <10 | <10 | <1 | <10 | ○ | ○ |
| Re-2 | This Example twice EB-melted | <1 | <1 | <1 | <0.1 | <0.1 | <0.1 | <0.1 | 15 | 15 | <1 | <10 | ○ | ○ |
| Re-3 | This Example twice EB-melted | <1 | <1 | <1 | <0.1 | <0.1 | <0.1 | <0.1 | 12 | 12 | <1 | <10 | ○ | ○ |
| Re-4 | This Example twice EB-melted | <1 | <1 | <1 | <0.1 | <0.1 | <0.1 | <0.1 | <10 | <10 | <1 | <10 | ○ | ○ |
| Re-5 | This Example twice EB-melted | <1 | <1 | <1 | <0.1 | <0.1 | <0.1 | <0.1 | <10 | <10 | <1 | <10 | ○ | ○ |
| Re-6 | This Example twice EB-melted | <1 | <1 | <1 | <0.1 | <0.1 | <0.1 | <0.1 | <10 | <10 | <1 | <10 | ○ | ○ |
| R-7 | Comp. Example twice EB-melted | <20 | 400 | 500 | 2.5 | 1.5 | 2.2 | 1 | 60 | 50 | <1 | <10 | Δ | X |

○ No intergranular cracking
Δ Some intergranular cracking
X Much intergranular cracking For these chemical analyses of the specimens, the upper, middle, and lower parts of each ingot were sampled to obtain disk-shaped specimens, and the arithmetic mean of the analytical values of central and peripheral portions of each specimen was recorded. The amount of the impurity metals was no more than 1 ppm (excepting the refractory metal to be refined), that of gas ingredient impurities such as oxygen, nitrogen, and carbon was less than 10 ppm each (no more than 20 ppm in Re-2 and Re-3 only), and the amounts of radioactive elements uranium and thorium were no more than 1 ppb each.

As will be appreciated from these tables, the ingot obtained in Example 3 of this invention was purified to a strikingly high degree, like the counterparts of Examples 1 and 2. This is because an additive element is used in EB melting and the various impurities contained in the ingot are volatilized altogether in the form of lower compounds or nonstoichiometric compounds formed between the additive element and the impurity gas ingredient elements (including ones from the stoichiometric compounds formed between the additive element or impurity metal and impurity gas ingredient elements or between the impurity metals being caused to undergo phase transformation under elevated temperature and pressure involved) are volatilized altogether. This action for removal of impurities centered around the gas ingredients is surprizing and amazing. While this example used iron primarily as an additive element, it is not a limitation. As Re-1 to Re-6 indicate, a transition metal element of vanadium, chromium, manganese, cobalt, or nickel or a rare earth element proves similarly effective.

As regards Mo, W, and Re, they ordinarily have a tendency of being relatively easily freed from the impurities such as gas ingredients by EB melting, but even greater impurity removal effects were achieved in this example, as shown in Tables 9, 10, and 12. It will also be seen that the removal rates of the radioactive element U and alkali metals Na and K are outstanding too.

To evaluate the workability of the test specimens, lathe working and extrusion working were performed. The lathe was operated using a boron nitride (BN) cutting tool (depth of cut=0.1–0.15 mm; rake angle=30°–40°; peripheral speed=5–15 m/min; feed=0.1–0.3 mm). For the extrusion, each material was formed into a billet 35 mm in diameter and 200 mm long and the billet was extruded by a 2000-ton extrusion press into a plate 10 mm by 50 mm by a corresponding length.

Conventionally EB-melted materials have the tendency of the grains coming off due to cracking along the grain boundaries. In this example, by contrast, no intergranular cracking was observed, indicating a remarkable improvement in workability. The results were similar to those of Examples 1 and 2.

With regard to Ta, hot forging was followed by cold rolling. The Ta material could be rolled from the thickness of 35 mm down to 2 mm without any intermediate heat treatment. No intergranular cracking occurred. The rolled surface had a metallic luster of high brightness.

With Ta, as is manifest from Table 11, the impurity volatilization removal effect of the invention is conspicuous. Ta is a material having relatively good workability by nature with a small possibility of intergranular cracking, and rather what matters with Ta is the deterioration of corrosion resistance with impurities.

As the results of Ta corrosion resistance tests given in Table 11 show, the specimen of this example had a clear, whitish silver metal luster on the etched surface (as compared with a whitish grey of the comparative specimen) and, after the lapse of one year, showed no surface change, indicating its excellent corrosion resistance. In respect of the etching property, the specimen of the invention took a longer etching time than the comparative specimen before the macrostructure comes out. This means that the material obtained in this example had stronger resistance to etching owing to its high crystalline regularity. Conversely, the conventional material is presumably etched within a short time because of a thick deformed layer formed in the presence of impurities.

The Ta surface processed as described above was inspected for a change with time (43200 sec.). Whereas the conventional material gradually lost its metallic luster, the material of this example showed almost no such change with time.

[ADVANTAGES OF THE INVENTION]

This invention provides an epochal method of refining refractory metals (including alloys and intermetallic compounds) including niobium, rhenium, tantalum, molybdenum, and tungsten or an alloy based thereon by EB melting or the like, by which all the various impurities contained in the metal are volatilized altogether in the form of lower compounds or non-stoichiometric compounds formed between the additive element and the impurity gas ingredients (including ones from the stoichiometric compounds formed between the additive element or impurity metal and impurity gas ingredients or between the impurity metals having been caused to undergo phase transformation under elevated temperature and pressure involved) and consequently the impurity removal effect is remarkably enhanced.

The method of this invention offers another advantage of attaining a high degree of purification with a smaller repetition number of melting than heretofore, thanks to the remarkably enhanced volatilization refining effect.

Additional advantages of this method are that, because purification to more than 5N (99.999%) purity is accomplished with a short melting period, the saving of manufacturing cost is substantial and refractory metals of high quality can be made at low cost.

This invention renders it also possible to remarkably bring down the lower limit for impurity removal (the minimum residual amounts of impurities), improve the grain boundaries, increase the workability, and widely increase the material yield.

Further enhancements are made in the physical and mechanical properties of refractory metals by high purification and in the plastic workability through control of the solidification structures of refractory metals. Examples of the improvements attained are: in the physical properties (superconductivity, electric properties, thermal conductivity, crystalline ordering etc.) of niobium by high purification; in the workability (forging, rolling, etc.) and resistance to heat and corrosion of molybdenum and tungsten by high purification; and in the workability (forging, rolling, etc.) and corrosion resistance of niobium, tantalum, and rhenium by high purification and in the workability (forging, rolling, etc.) through control of the solidification structures.

What we claim is:

1. A method of manufacturing a high-purity refractory metal or a refractory metal based alloy, said refractory metal being selected from the group consisting of niobium, rhenium, tantalum, molybdenum, and tungsten, comprising the steps of:

compacting a mixed material, in the form of powders or small lumps, of a refractory metal or alloy to be refined together with one or two or more additive elements selected from the group of transition metal elements consisting of vanadium, chromium, manganese, iron, cobalt and nickel, and from the group of rare earth elements, sintering the resulting compact at a high temperature of at least 1000° C. and a high pressure of at least 100 MPa, and thereafter electron-beam melting the sintered body.

2. The method of claim 1 wherein the amount of the additive element or elements has an upper limit of 3% by weight.

3. The method of claim 1 wherein the amount of the additive element or elements has an upper limit of 1% by weight.

4. The method of claim 1 wherein the mixed materials in the form of powders or small lumps to be melted for refining are subjected to cold isostatic pressing (CIP) and then to hot isostatic pressing (HIP) at high temperature and pressure of 1000° C. and 100 MPa, and thereafter electron-beam melted.

5. A method of manufacturing a high-purity refractory metal or a refractory metal based alloy, said refractory metal being selected from the group consisting of niobium, rhenium, tantalum, molybdenum, and tungsten, comprising the steps of:

compacting a mixed material, in the form of powders or small lumps, of a refractory metal or alloy to be refined together with one or two or more additive elements selected from the group of transition metal elements consisting of vanadium, chromium, manganese, iron, cobalt and nickel, and from the group of rare earth elements, sintering the resulting compact at a high temperature of at least 1000° C. and a high pressure of at least 100 MPa, thereby forming a lower compound or nonstoichiometric compound between at least a part of the additive element or elements and the impurity gas ingredients, such as oxygen O, nitrogen N, carbon C, and hydrogen H, contained in the refractory metal or alloy to be refined, and thereafter electron-beam melting the sintered body.

6. The method of claim 5 wherein the lower compound or nonstoichiometric compound is $Me_{1-x}Ga$ where $0 \leqq x < 1$, Me is one or two or more transition metal elements or rare earth elements selected from the group consisting of vanadium, chromium, manganese, iron, cobalt, and nickel or of rare earth elements, and Ga is impurity gas ingredients, such as O, N, C, and H.

7. The method of claim 5 wherein the lower compound or nonstoichiometric compound formed by sintering at high temperature and pressure is removed by vaporization refining during the electron-beam melting.

8. The method of claim 5 wherein the amount of the additional element or elements has an upper limit of 3% by weight.

9. The method of claim 5 wherein the amount of the additional element or elements has an upper limit of 1% by weight.

10. The method of claim 5 wherein the mixed materials in the form of powders or small lumps to be melted for refining are subjected to cold isostatic pressing (CIP) and then to hot isostatic pressing (HIP) at high temperature and pressure of 1000° C. and 100 MPa, and thereafter electron-beam melted.

11. The method of claim 1 wherein the refractory metal is niobium or an alloy based thereon and has a Vickers hardness $Hv \leqq 60$ and a relative residual resistivity (RRR) value of at least 1000.

12. The method of claim 1 wherein the refractory metal is rhenium, tantalum, or an alloy based on either metal.

13. The method of claim 1 wherein the refractory metal is molybdenum, tungsten, or an alloy based thereon.

14. The method of claim 1 wherein the additive element or elements are one or two or more elements selected from the group consisting of transition metal elements.

15. The method of claim 1 wherein the additive element is iron.

16. The method of claim 1 wherein the amounts of the residual impurity gas ingredients may be such that oxygen $O \leqq 50$ ppm, nitrogen $N \leqq 50$ ppm, and carbon $C \leqq 50$ ppm.

17. The method of claim 1 wherein the total amount of the residual impurity gas ingredient elements is such that $O+N+C \leqq 100$ ppm.

* * * * *